US011776344B1

(12) United States Patent
Ogram

(10) Patent No.: US 11,776,344 B1
(45) Date of Patent: Oct. 3, 2023

(54) BALLOT DROP BOX

(71) Applicant: Mark Ogram, Tucson, AZ (US)

(72) Inventor: Mark Ogram, Tucson, AZ (US)

( * ) Notice: Subject to any disclaimer, the term of this patent is extended or adjusted under 35 U.S.C. 154(b) by 0 days.

(21) Appl. No.: 17/803,761

(22) Filed: Nov. 14, 2022

(51) Int. Cl.
*G07C 13/02* (2006.01)
*G07C 13/00* (2006.01)

(52) U.S. Cl.
CPC ..... *G07C 13/02* (2013.01); *G07C 13/005* (2013.01)

(58) Field of Classification Search
CPC ..... G07C 13/00
USPC ..... 235/57
See application file for complete search history.

(56) References Cited

U.S. PATENT DOCUMENTS 5,362,928 A 11/1994 Pavlik
7,974,927 B2 7/2011 Reisinger
D794,273 S 8/2017 Abel
10,210,691 B1 2/2019 Lantz
D888,364 S 6/2020 Dcatch
10,696,453 B2 6/2020 Sena
D909,888 S 2/2021 Huang
11,485,373 B2 11/2022 Bosc
11,485,515 B2 11/2022 Alberda
11,488,441 B2 11/2022 Palmisano
11,488,480 B1 11/2022 Balasubramanian
11,491,796 B2 11/2022 Araki
11,491,799 B2 11/2022 Okamoto
11,491,807 B2 11/2022 Fukuzawa
2008/0294474 A1* 11/2008 Furka ..... G06Q 10/08355 705/7.26

* cited by examiner

*Primary Examiner* — Jamara A Franklin
(74) *Attorney, Agent, or Firm* — Mark Ogram

(57) ABSTRACT

A ballot drop box adapted to collect voting ballots. The drop box is a shell having an interior and an exterior. A chute is used by the voter to deposit their ballot. Within the drop box is a scale which collects the deposited ballot from the chute. The scale determines if a single ballot has been deposited or multiple ballots. Based on this determination, the ballot(s) are sent to an "acceptable" bin within the box or to a "further investigation needed" bin. An alternative embodiment marks the she submitted ballot(s) allowing a later determination if the ballots have been "stuffed".

21 Claims, 2 Drawing Sheets

BALLOT DROP BOX

Figures 1A, 1B, 1C:
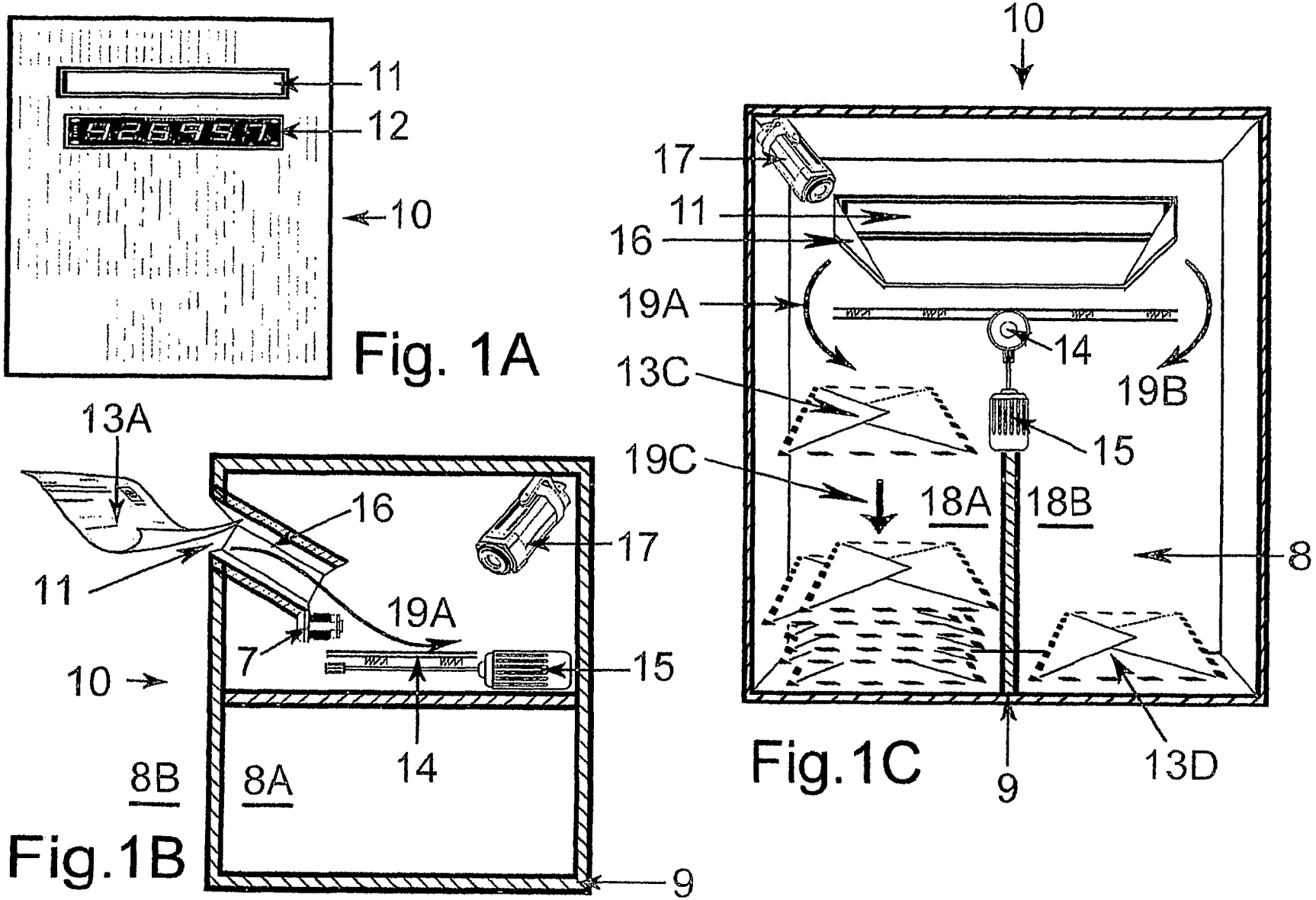

BACKGROUND OF THE INVENTION:

This invention relates generally to elections and more particularly to drop boxes adapted to receive completed ballots.

In order to facilitate voting, many states have gone to including drop boxes allowing the voter to deposit their completed ballot into a secure receptacle. Unfortunately, these drop boxes also encourage the "stuffing" of ballots wherein a person, with illegal ballots, deposits two or more illegal ballots into the drop box. Often, it has been shown, the illegal ballots are deposited several at a time, and once mixed with the legally deposited ballots are impossible to identify.

It is clear there is a need for better control and verification of remote balloting through drop boxes.

SUMMARY OF THE INVENTION:

The invention provides for a ballot drop box adapted to collect voting ballots. The drop box is a shell having an interior and an exterior. A chute is used by the voter to deposit their ballot. Within the drop box is a scale which collects the deposited ballot from the chute. The scale determines if a single ballot has been deposited or multiple ballots. Based on this determination, the ballot(s) are sent to an "acceptable" bin within the box or to a "further investigation needed" bin.

In this context, the term "ballot" means the combination of the voting ballot contained within its envelope.

Ballot boxes are well known to those of ordinary skill in the art and include, but are not limited to those described in U.S. Pat. No. 10,210691, entitled "Locking Ballot Depository with Baffle" issued to Lantz et al. on Feb. 19, 2019; and U.S. Pat. No. D794,273, entitled "Ballot Box Storage and Transport Cart" issued to Abel et al. on Aug. 8, 2017; both of which are incorporated hereinto by reference.

Within this invention, a ballot drop box is created. The box is a shell having an interior and an exterior. The user, places the completed ballot in a chute which transports the ballot into the interior of the ballot drop box. Legally, only a single ballot is to be deposited, but, often, in ballot "stuffing" fraud, multiple ballots are deposited and are typically placed into the box at the same time.

Whether it is single ballot, or a group of ballots, in the preferred embodiment the ballot(s) are conveyed by chute to be deposited onto a sale which generates a weight of the ballot(s). This weight determines if a single ballot has been deposited into the drop box, or if multiple ballots have been illegally deposited.

Once the weight of the ballot has been determined, the scale is tipped one way or the other to deposit the ballot(s) into the proper bin (tipped one way for a single legal ballot; tipped the other way to deposit the illegal ballots into a second bin.

The typical container is well known to those of ordinary skill in the art and include but are not limited to those described in U.S. Pat. No. D909,888 entitled "Combined Container and Consumer Product" issued to Huang et al. on Feb. 9, 2021; U.S. Pat. No. 10,696,453, entitled "Collapsible Folding Container" issued to Sena on Jun. 30, 2020; and U.S. Pat. No. D888,364, entitled "Suggestion Box" issued to Dratch on Jun. 23 2020; all of which are incorporated hereinto by reference.

Ideally, the tipping action is accomplished using a motor secured to the scale. The motor is controlled by a controller or computer which receives the weight from the scale. The acceptance of a "legal" submission uses a weight value which assures that only a single ballot is counted. This is often 150% of the weight of a single ballot.

Computers and controllers are well known in the art and include, but are not limited to those described in U.S. Pat. No. 11,488,441 entitled "System and Method for Changing Beacon Identifiers for Secure Mobile Communications" issued to Palmisano et al. on Nov. 1, 2022; U.S. Pat. No. 11,488,515, entitled "Method and System for Operating an Aircraft" issued to Alberda on Nov. 1, 2022; and U.S. Pat. No. 11,488,480, entitled "Passive Vehicle-to-Pedestrian System" issued to Balasubramanian et al. on Nov. 1, 2022; all of which are incorporated hereinto by reference.

In a similar manner, scales to determine weight are also well known to those of ordinary skill I the art, and include but are not limited to those described in U.S. Pat. No. 7,974,927, entitled "Mailing Machine and Initialization Method" issued to Reisinger on Jul. 5, 2011; and U.S. Pat. No. 5,362,928, entitled "Scale with Rolling-fulcrum" issued to Pavlik on Nov. 8, 1994; both of which are incorporated hereinto by reference.

In another embodiment of the invention, a marking apparatus is used to print onto the ballot(s) as they pass through the chute or are on the scale. This printing is in any configuration such as a line, the date printed onto an exposed ballot, or a serial number of the actual drop box.

Those of ordinary skill in the art readily recognize a variety of mechanisms which can be used to print onto the ballots, including, but not limited to: U.S. Pat. No. 11,491,796, entitled "Inkjet Printing Apparatus and Ink Tank" issued o Araki et al. on Nov. 8, 2022; U.S. Pat. No. 11,491,807 entitled "Printing Apparatus" issued to Fukuzawa on Nov. 8, 2022; and, U.S. Pat. No. 11,491,799, entitled "Printing Apparatus" issued to Okamoto on Nov. 8, 2022; all of which are incorporated hereinto by reference.

As example, assume that there has been an illegal "stuffing" of multiple ballots. In this case the mark is done either to the top ballot or the bottom ballot, thus leaving the excess ballots "blank" (without any marking) and easily recognizable by the human or machine checkers to dispose of the excess ballots.

In yet another embodiment, two printers are used to print on both the top and bottom of the ballot(s). In this embodiment, only the ballots with a printing on the top and the bottom are counted. In this embodiment, there isn't any need for the scale/tilting aspect as noted above; all the ballot(s) are received into a single bin after being "marked".

In order to assist in keeping the stuffing agent from merely creating a stream of single ballots into the drop box, one embodiment utilizes a door which is used to "close" the exterior access to the chute. In one embodiment the door remains closed for a certain period of time (say 30 seconds) or, alternatively, until the person leaves the drop box.

In the preferred aspect of the door embodiment, the door is controlled by the controller/computer.

In the embodiment which opens the door after the user has moved away from the drop box by a certain distance (say six feet), a distance sensor is used. This required movement dissuades the stuffier as it requires much more effort and is very discernable by any observer or by monitoring cameras.

Distance sensors are well known to those of ordinary skill in the art and include, but are not limited to those described in U.S. Pat. No. 11,485373, entitled "Method for a Position Determination of a Vehicle, Control Unit and Vehicle" issued to Niem et al. on Nov. 2022, incorporated hereinto by reference.

As a further enhancement, a status indicator, controlled by the controller/computer, provides a reading for a poll maintenance worker on when the box is full or needs battery, ink, or other such maintenance.

The status indicator also alerts the poll maintenance work when the drop box is full of ballots by using either a distance sensor into each bin or a scale at the bottom of each bin.

The invention, together with various embodiments thereof, will be explained in detail by the accompanying drawings and the following descriptions thereof.

DRAWINGS IN BRIEF:

FIGS. 1A, 1B, and 1C illustrate the preferred embodiment of the invention sowing the front (with skin), the side (without skin), and the back (without skin) of the ballot box.

Figure 2A:
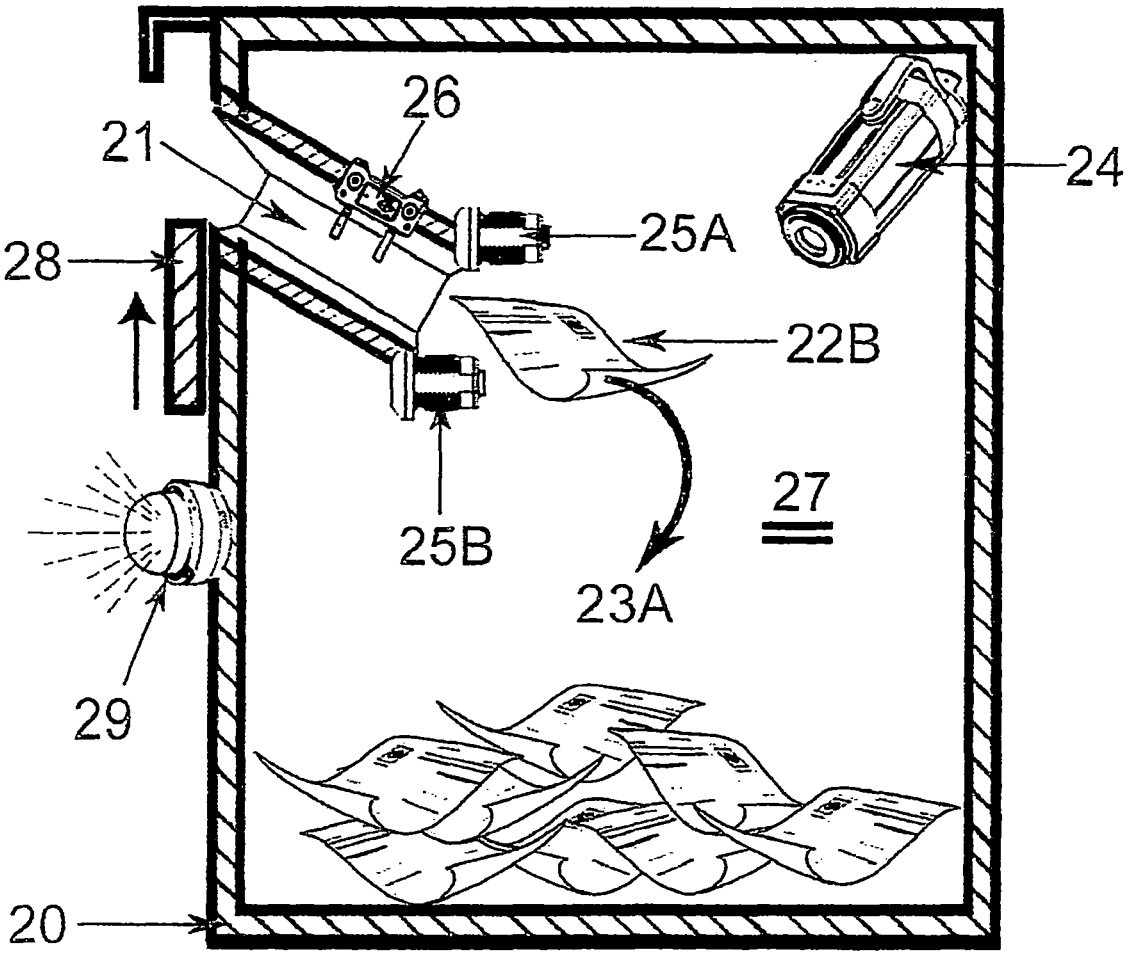
Figure 2B:
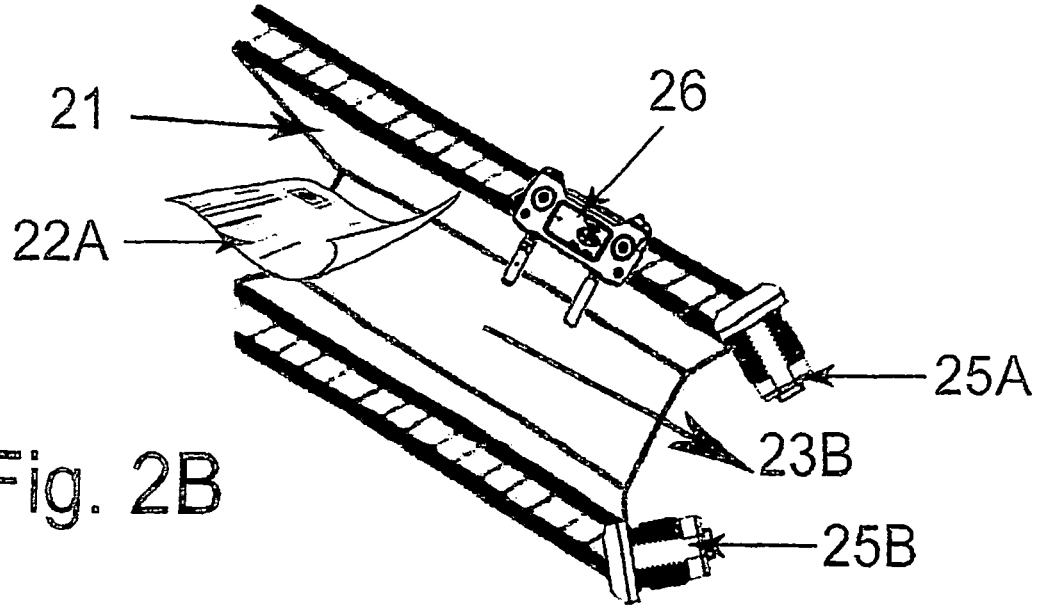

FIGS. 2A and 2B illustrate another embodiment of the invention.

DRAWINGS IN DETAIL:

FIGS. 1A, 1B, and 1C illustrate the preferred embodiment of the invention sowing the front (with skin), the side (without skin), and the back (without skin) of the ballot box.

A ballot drop box 10 is created which has a shell 9 creating an interior 8A and an exterior/outer 8B. Chute 16 communicates ballots 13A from slot 11 into the interior 8A of the shell 9. This ballot 13A (only one ballot is shown but in illegal stuffing many ballots are inserted simultaneously or one at a time) is communicated to scale 14 as shown by arrow 16. The scale 14 generates a weight of the ballot(s) 13A and communicates the weight to controller 17.

Controller 17 causes motor 15 to tilt scale 14 (arrow 19A and 19B) based upon the weight of ballot 13A from scale 14. If the weight indicates that a single ballot is received (a legal deposit), the ballot falls into bin 18A (legal submission of the ballot). If the weight indicates that more than one ballot 13A has been deposited, controller/computer 17, via the motor 15, causes the ballots to be deposited into bin 18B indicating that these are not acceptable ballots.

In some embodiments of the invention, scales are provided at the bottom of the bins 18A and 18B which report on the weight within the respective bins allowing the controller 17 to determine when the bins 18A and 18B are at, or near, capacity. This fact is reported by the controller to a poll work via display 12.

Alternatively, distance sensors are employed to scan into the bins 18A and 18B and generate a reading of the amount/number of ballots which have been deposited In some embodiments of this invention, marker 7 places a mark (visible or invisible) onto the bottom most ballot as it passes through the chute 16. In the case of multiple (illegal deposit) ballots being deposited, the bottom most ballot (in this illustration) is marked allowing this ballot to be counted. Hence, if, say, ten ballots are deposited simultaneously, the bottom most ballot would be marked allowing it, and not the other ballots, to be counted.

Alternatively, the marking of the ballot can be made on the upper most ballot, giving the same result.

This marking allows the illegally tendered voting ballots to remain within their envelopes so that their status does not become confused, such as when the ballot and envelope are separated in the current practice.

In one embodiment, the marking being performed on the ballot is an indicia and includes a current date and/or an identifier of the drop box itself.

FIGS. 2A and 2B illustrate another embodiment of the invention.

The ballot drop box of this embodiment has a shell 20 which creates an interior 27 and an exterior. Chute 21 communicates a ballot 22B into the interior of shell 20. As ballot 22B passes through chute 21, sensor 21 identifies that there is a ballot within chute 21 and markers 25A and 25B deposit ink onto the ballot. This ink is chosen to be visible or invisible. Optionally, controller 24 controls the markers in response to sensor 21.

The now marked ballot 22B is collected within bin 27 for removal by the poll worker. At the counting station, any ballot envelope that does not have markings on the top and bottom of the ballot envelope is not opened since this indicates that multiple ballot envelopes were deposited simultaneously, thus indicating an illegal deposit since the voting ballot and the envelope are maintained intact, the fraudulent vote never enters the counting stage of the election.

Additionally, ideally, the marking mechanism posts an identifier of the ballot drop box 20 so that inspectors know from which box the ballots originated and can trace the individuals doing the stuffing.

To dissuade an illegal use of the box by simply putting one ballot envelope at a time and still depositing ballots illegally (e.g. stuffing) door 28 selectively activated by controller 24 to close access to chute 21. Door 28 is kept closed for a period of time to discourage the stuffing individual, or until the individual vacates the front of the ballot drop box 20 as indicated by distance sensor 29 (say six feet). In this manner, the stuffing individual is forced to either wait or step away from the box before making another deposit making heir actions all too obvious It is clear the present invention provides better control and verification of remote balloting through drop boxes.

What is claimed is:

1. A ballot drop box comprising:

a shell having an interior and an exterior;

a chute accepting at least one ballot and communicating the at least one ballot into the interior of the shell;

a scale located in the interior portion of the shell, said scale accepting the at least one ballot from the chute, said scale generating a weight indicia of the at least one ballot; and, wherein the scale tilts according to the weight indicia to deposit the at least one ballot into a first or second bin within the interior of the shell.

2. The ballot drop box according to claim 1, further including:

a motor connected to the scale for selective tilting the scale; and a controller receiving the weight indicia from the scale and operating the motor to tilt the scale in response thereto.

3. The ballot drop box according to claim 2, further including a marker selectively printing an indicia onto one of the at least one ballot as it passes through the chute.

4. The ballot drop box according to claim 3, wherein the marker prints the indicia on a top of one of the at least one ballot.

5. The ballot drop box according to claim 3, wherein the marker prints the indica on a bottom one of the at least one ballot.

6. The ballot drop box according to claim 2, further including a door selectively activated to close exterior access to the chute, and, wherein the controller selectively closes the door after a ballot has passed through the chute.

7. The ballot drop box according to claim 6, wherein the controller selectively opens the door after a predetermine amount of time.

8. The ballot drop box according to claim 6, further including a distance sensor generating a distance measurement from the shell to a user of the ballot drop box; and, wherein the controller maintains the door in a closed condition until the distance measurement exceeds a predetermined distance value.

9. The ballot drop box according to claim 2, further including a status indicator located on an exterior surface of the shell; and, wherein, the controller adjusts the status indicator based on a condition of the first and second bin.

10. The ballot drop box according to claim 9, further including sensor generating a level measurement of ballots within the interior of the shell; and, wherein the controller adjusts the status indicator based upon the level measurement.

11. The ballot drop box according to claim 10, wherein the sensor is a first and second scale determining a weight of ballots within each of the first and second bins.

12. A ballot drop box comprising:

a shell having an interior and an exterior with a chute communicating from an exterior to the interior portion; and, a scale collecting at least one ballot deposited into the chute, said scale tilting in response to a number of ballots within the at least one ballot such that the at least one ballot is deposited in a first or second bin in the interior of the shell.

13. The ballot drop box according to claim 12, further including:

a motor connected to the scale for selective tilting of the scale; and a controller activating the motor to tilt the scale.

14. The ballot drop box according to claim 13, further including a marker selectively printing an indicia onto one of the at least one ballot as it passes through the chute.

15. The ballot drop box according to claim 14, wherein the indicia includes a current date.

16. A ballot drop box comprising:

a shell having an interior portion and an exterior portion with a chute communicating at least one ballot to the interior portion;

a marking mechanism marking the ballot passing through the chute; and, a door selectively closing access to the chute.

17. A ballot drop box according to claim 16, wherein the marking mechanism posts an identifier associated with the ballot drop box.

18. The ballot drop box according to claim 16 , wherein the marking mechanism marks both sides of the at least one ballot passing through the chute.

19. The ballot drop box according to claim 16 further including a distance sensor generating a distance measurement from the shell to a user of the ballot drop box; and, wherein the door is maintained in a closed condition until the distance measurement exceeds a predetermined distance value.

20. A ballot box assembly comprising:

a shell having an interior and an exterior and a first and second bin within the interior;

a chute accepting at least one ballot and communicating the at least one ballot into an interior of the shell;

a scale within the shell and depositing the at least one ballot into either the first or second bin depending on a weight of the at least one ballot;

a status indicator visible on an exterior of the shell;

a level sensor generating a first level data indicative of a level of ballots within the first bin, and a second level data indicative of a level of ballots within the second bin; and, wherein the status indicator receives the first level data and the second level data from the level sensor and communicates the first level data and the second level data to an operator.

21. The ballot box assembly according to claim 20, wherein the first and second bin are removable from the interior of the shell.

* * * * *